US006260366B1

(12) United States Patent
Pan

(10) Patent No.: US 6,260,366 B1
(45) Date of Patent: Jul. 17, 2001

(54) HEAT RECYCLING AIR-CONDITIONER

(76) Inventor: Chi-Chuan Pan, No. 4, Lane 99, Sec. 1, Kuangfu Rd., Sanchung City, Taipei Hsien (TW)

( * ) Notice: Subject to any disclaimer, the term of this patent is extended or adjusted under 35 U.S.C. 154(b) by 0 days.

(21) Appl. No.: 09/484,052

(22) Filed: Jan. 18, 2000

(51) Int. Cl.[7] ..... F25D 17/06; F25B 29/00
(52) U.S. Cl. ..... 62/173; 62/90
(58) Field of Search ..... 62/183, 90, 173, 62/176.5

(56) References Cited

U.S. PATENT DOCUMENTS 2,291,029 * 7/1942 Everetts, Jr. ..... 62/173
4,271,678 * 6/1981 Liebert ..... 62/173
5,228,302 * 7/1993 Eiermann ..... 62/90

* cited by examiner

*Primary Examiner*—William Wayner
(74) *Attorney, Agent, or Firm*—Jones, Tullar & Cooper, P.C.

(57) ABSTRACT

A heat-recycling air conditioner is disclosed, which includes a first loop having a compressor, a condenser and an evaporator and a second loop having a condenser cooling water inlet and an outlet, an auxiliary heat exchanger and a source of cooling water. The cooling water flows to the condenser to absorb the heat from the coolant and then the heated cooling water flows to an auxiliary heat exchanger to add extra heat to the discharge air.

1 Claim, 3 Drawing Sheets

HEAT RECYCLING AIR-CONDITIONER

BACKGROUND OF THE INVENTION

1. Field of the Invention

The present invention relates to a air-conditioner, and more particularly to a heat recycling air-conditioner, which uses the heat gained from the cooling water to maintain the temperature stable without using an extra heating device to provide heat to a blower when the temperature is below a predetermined temperature. With such an arrangement, the temperature of the air blown by the blower can be kept stable.

2. Description of Related Art

Normally there are two different techniques used in an air-conditioner. One uses cooling water to provide the necessary heat to maintain the indoor temperature stable, as shown in FIG. 2. The other uses coolant to provide the necessary heat to maintain the indoor temperature stable, as shown in FIG. 3. With reference to FIG. 2, a conventional air-conditioner (20) comprises a condenser (21) with an inlet and an outlet (not numbered), a compressor (22) connected to the condenser (21) and an evaporator (23) connected to both the condenser (21) and the compressor (22). When the cooling water flows out of the condenser (21) and reaches the evaporator (23), the heat of the cooling water will be blown through a heater (24). The heater (24) controlled by a controller (25) is activated when a sensor (26) mounted on the outlet of the air-conditioner detects that the temperature of the discharged air is below a predetermined value and sends out a signal to the controller (25). After the controller (25) receives the signal, the heater (24) is turned on to heat up the air discharged from the evaporator (23), so that, the temperature of the air blown out of the air blower (27) can be kept stable. However, such a structure consumes too much energy. That is, the condenser (21) needs power to operate and also the heater (24) needs power to keep it running. With reference to FIG. 3, an air-conditioner with coolant has a compressor (30) connected to a condenser (32) that is connected to an evaporator (31) that is connected to the compressor (30) to form a closed loop. The coolant flows from the compressor (30) at a high pressure and a high temperature. When the coolant flows through the condenser (32), the heat of the coolant is absorbed by the condenser (32) to cool down the temperature of then coolant. After the low temperature, high pressure coolant comes out of the condenser (32) it passes through a valve and becomes low temperature and low pressure. When going through the evaporator (31), the temperature of the coolant is heated up again to become a coolant with high temperature and low pressure, which in turn once again is pressurized by the compressor (30) to complete the cycle. One good thing about this kind of structure is that it is necessary to add any other heater to heat up the temperature blown by the air blower (33) so there is no concern about energy consumption. However, with such and an arrangement, there is no way to maintain the exhaust temperature stable.

To overcome the noted shortcomings, the present invention provides an improved air-conditioner to mitigate or obviate the aforementioned problems.

SUMMARY OF THE INVENTION

The main objective of the present invention is to provide an improved airconditioner with heat recycling capability. A volume control valve is provided to control the net flow of cooling water ana three-way electric valve is provided to turn on or shut down the flow of cooling water into an auxiliary heat exchanger so as to radiate the heat of the cooling water out to the exhaust air and then circulate the cooling water back to a reservoir. It is to be noted that the air conditioner in accordance with the present invention does not need any other heating device to provide extra heat and is still able to keep the temperature stable.

Other objects, advantages and novel features of the present invention will become more apparent from the following detailed description when taken in conjunction with the accompanying drawings.

DETAILED DESCRIPTION OF PREFERRED EMBODIMENT

Figure 1:
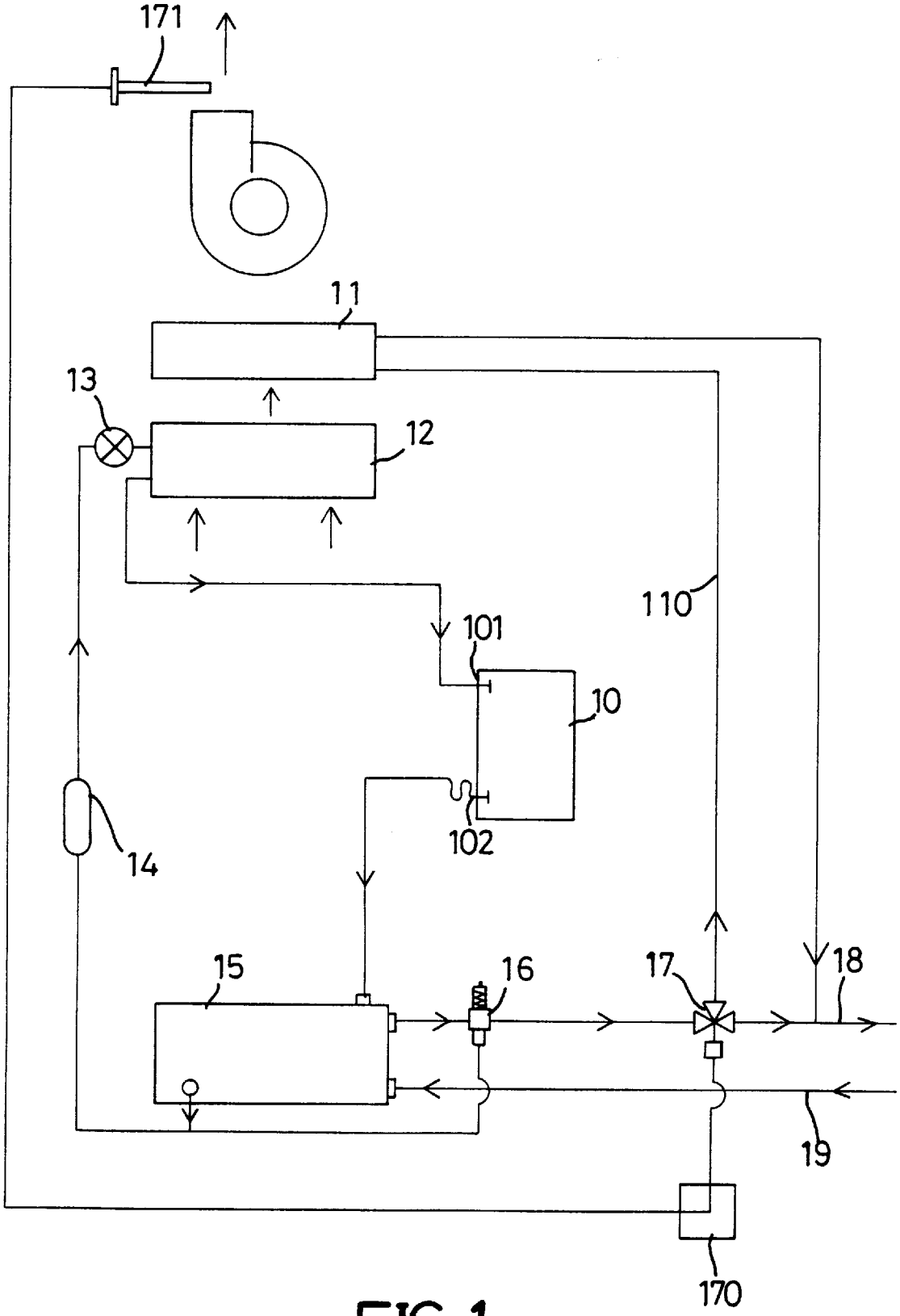
FIG. 1 is a schematic diagram showing the circulation cycle of cooling water in a heat-recycling air-conditioner in accordance with the present invention.
Figure 2:
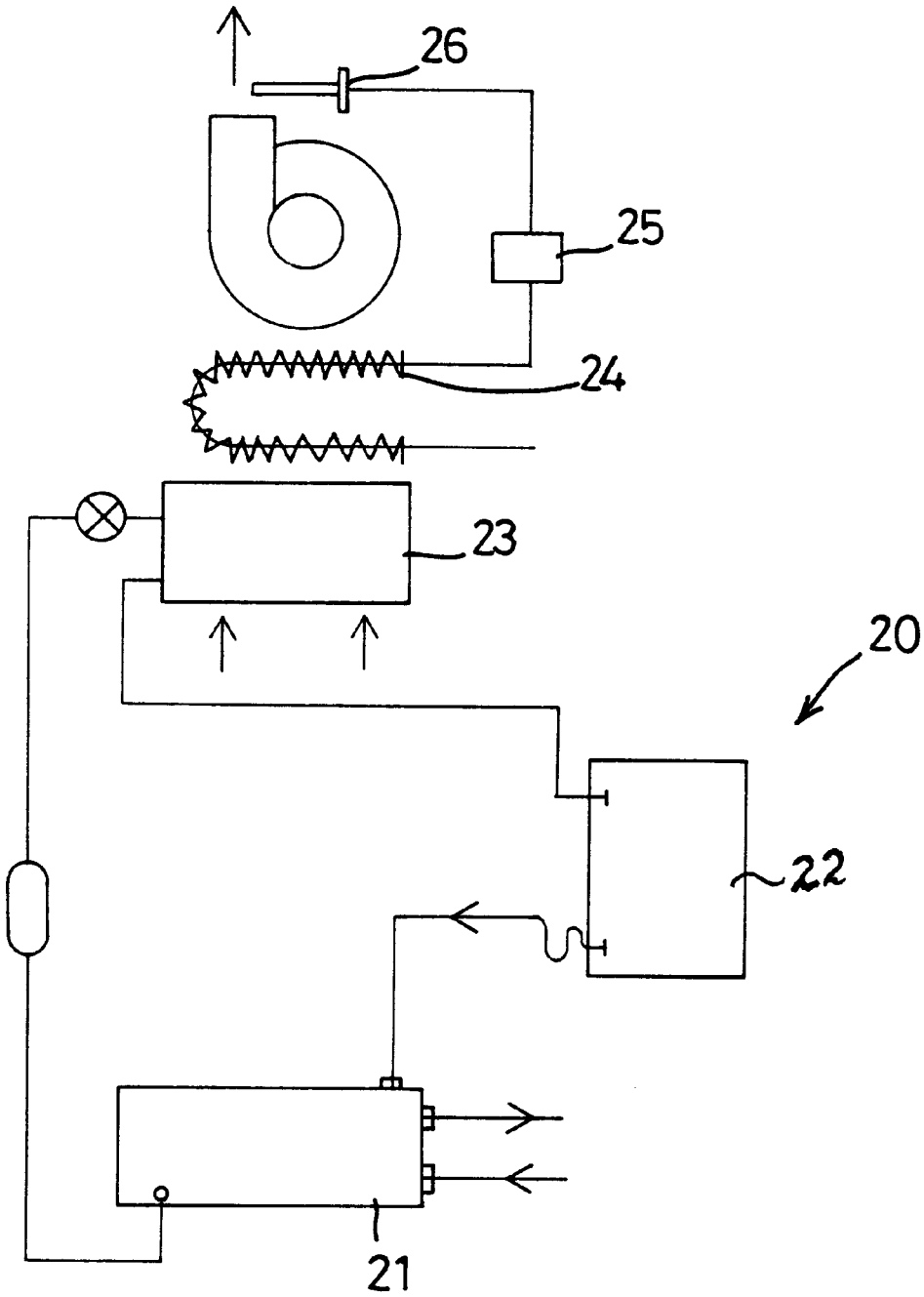
FIG. 2 is a schematic diagram showing the circulation cycle of cooling water in a conventional air-conditioner.
Figure 3:
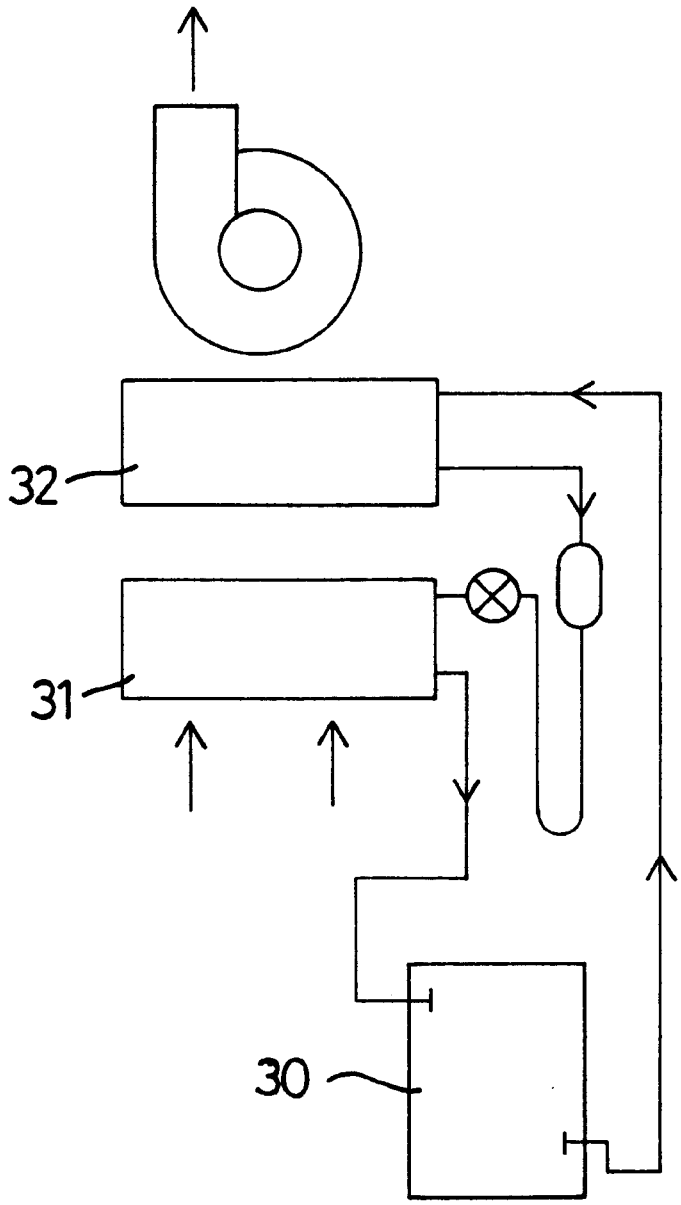
FIG. 3 is a schematic diagram showing the circulation cycle of cooling water in still a conventional air-conditioner.

With reference to FIG. 1, the air-conditioner in accordance with the present invention comprises a compressor (10) with an inlet (101) and an outlet (102), an evaporator (12) and a condenser (15). The compressor (10) is connected to both the evaporator (12) and the condenser (15) and the loop is the same as that described earlier, such that detailed description of the connection of the basic elements is omitted. When the compressor (10) is running, the coolant will be sent to the condenser (15) at a high temperature and high pressure. After the coolant passes through the condenser (15), because the heat in the condenser (15) is absorbed by the coolant, the coolant flowing to the evaporator (12) will become cooler and still has the same pressure. After the coolant passes through the condenser (15), a filter (14) is provided to filter out any contaminants in the coolant and an expansion valve (13) is then provided to lower the pressure of the coolant. With such an arrangement, the coolant flowing into the evaporator (12) will be at a low temperature and low pressure and thereafter, the heat of the evaporator (12) is able to be absorbed by the coolant. After the absorption of the heat of the evaporator (12), the coolant becomes low pressure and high temperature and flows back into the compressor (10) to be pressurized again. Such a loop is conventional and has been used for years. However, it has its shortcomings as described in the background. Therefore, to improve the existing shortcoming of the loop, the invention provides a secondary loop for the condenser (15) cooling water. The secondary loop comprises an inlet (19) connected to the cooling water side of the condenser (15) and an outlet (18) connected to both the condenser (15) and an auxiliary heat exchanger (11), a volume control valve (16) mounted on the cooling water outlet (18) to control and monitor the flow of the cooling water away from the condenser (15), and a three-way electric valve (17) provided to control the flow ON/OFF of cooling water into the auxiliary heat exchanger (11) so as to radiate the heat of the cooling water out to the exhaust air and then circulate the cooling water back to a reservoir. A sensor (171) is mounted at the air conditioner outlet to monitor the discharge air temperature so as to send a signal to a controller (170) to activate the three-way electric valve (17).

After the cooling water flows into the condenser (15) and absorbs the heat from the coolant, the condenser (15) cooling water becomes hot water and flows to the auxiliary heat exchanger (11) when the three-way electric valve (17) is activated by the controller (170). When the sensor (171) at the air conditioner outlet senses that the discharge air temperature is below a predetermined temperature, the sensor (171) will send a signal to the controller (170) to activate the three-way electric valve (17) to connect the condenser (15) cooling water outlet (18) to the auxiliary heat exchanger (11). With such an arrangement, the temperature of the cooling water is radiated out from the auxiliary heat exchanger (11), such that the discharge air temperature controlled by the air conditioner is kept stable. Furthermore, when the discharge air temperature is too high or too low, the volume control valve (16) is able to regulate the flux of the cooling water into the auxiliary heat exchanger (11) so as to maintain the discharge air temperature in stable.

The air conditioner in accordance with the present invention needs no other heating device to provide extra heat to keep the discharge air temperature stable, such that the energy consumption of the heat recycling air-conditioner in accordance with the present invention is greatly reduced. Furthermore, because the sensor (171) monitors the discharge air temperature, the volume control valve (16) and the three-way electric valve (17) are able to correspondingly react to the sensor (171 ) to keep the temperature stable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of arts within the principles of the invention to the full extent indicated by the broad general eaning of the terms in which the appended claims are expressed.

What is claimed is:

1. A heat-recycling air conditioner comprising:

a first loop having:

a compressor;

an evaporator in communication with the compressor by an inlet of the compressor; and a condenser in communication with the evaporator and an outlet of the compressor;

wherein high temperature, high pressure coolant flows from the compressor to the condenser where the coolant is cooled;

low temperature, high pressure coolant flows from the condenser to the evaporator; and high temperature, low pressure coolant flows from the evaporator to the compressor to be pressurized; and a second loop for condenser cooling water having:

an inlet in communication with the condenser to provide cooling water to the condenser;

an outlet in communication with an auxiliary heat exchanger to release heat from the cooling water absorbed in the condenser to the exhaust air; and a three-way electric valve provided between the condenser and the auxiliary heat-exchanger to control the connection between the auxiliary heat exchanger and the condenser, whereby the high temperature cooling water is able to flow to the auxiliary heat exchanger to provide extra heat to the auxiliary heat exchanger, so that the exhaust air temperature of the air conditioner is able to be kept stable, wherein a sensor is provided at the outlet of the air conditioner to monitor the exhaust air temperature and a controller to receive signals from the sensor is provided to control the activation of the three-way electric valve.

* * * * *